United States Patent [19]

Feinstein

[11] Patent Number: 4,711,430

[45] Date of Patent: Dec. 8, 1987

[54] SIDE-INJECTED METAL REFINING VESSEL AND METHOD

[75] Inventor: Jonathan J. Feinstein, North Salem, N.Y.

[73] Assignee: Union Carbide Corporation, Danbury, Conn.

[21] Appl. No.: 846,801

[22] Filed: Apr. 1, 1986

[51] Int. Cl.[4] ..... C21C 5/44; C21C 5/48

[52] U.S. Cl. ..... 266/47; 266/218; 266/283

[58] Field of Search ..... 266/218, 265, 280, 283, 266/286, 44, 47

[56] References Cited

U.S. PATENT DOCUMENTS

| | | | |
|---|---|---|---|
| 3,724,830 | 4/1973 | Saccomano et al. | 266/222 |
| 3,816,720 | 6/1974 | Bauer et al. | 364/500 |
| 4,178,173 | 12/1979 | Gorges et al. | 75/59.22 |
| 4,208,206 | 6/1980 | Death | 75/43 |
| 4,418,893 | 12/1983 | Middleton et al. | 266/280 |

*Primary Examiner*—L. Dewayne Rutledge
*Assistant Examiner*—Robert L. McDowell
*Attorney, Agent, or Firm*—Stanley Ktorides

[57] ABSTRACT

A side-injected metal refining vessel having improved lining life having a defined refractory lining orientation in the area above a tuyere.

18 Claims, 2 Drawing Figures

FIG. 1
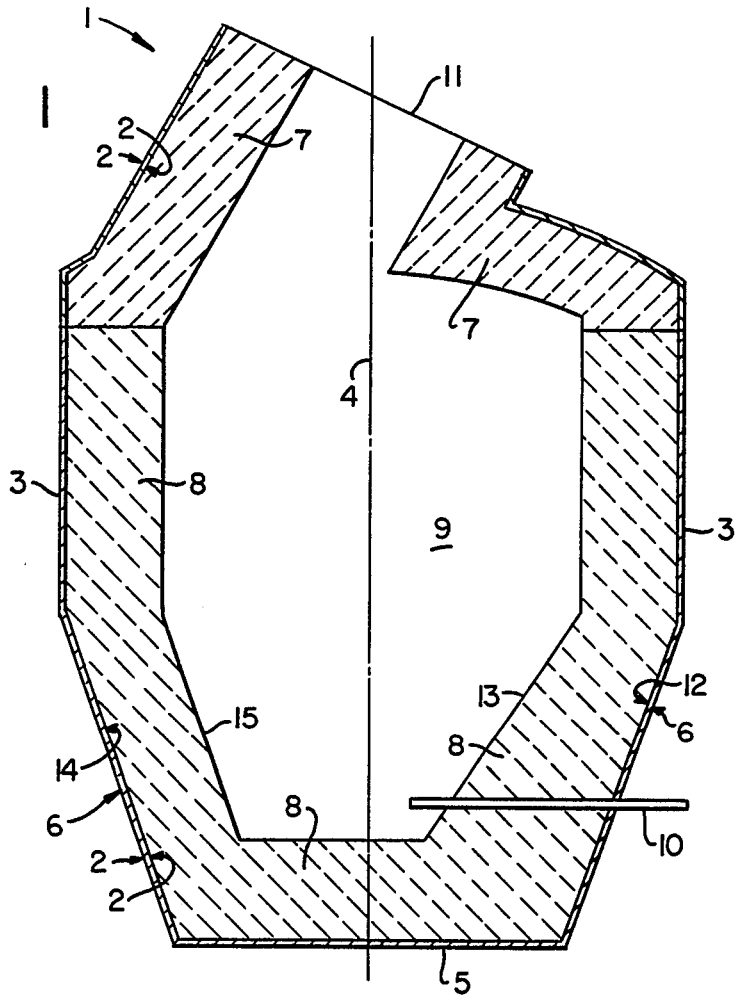
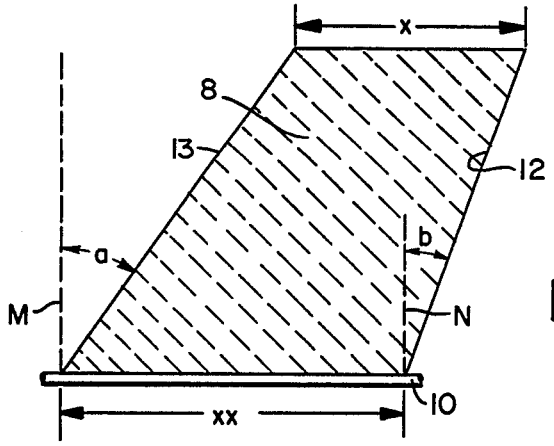
FIG. 2

SIDE-INJECTED METAL REFINING VESSEL AND METHOD

TECHNICAL FIELD

This invention relates to metal refining vessels wherein gas is injected through the side of the vessel and into a metal melt contained in the vessel.

BACKGROUND ART

Side-injected metal refining vessels, although a comparatively recent development, are widely used in such industries as the steelmaking industry because of the high mixing energy which is imparted to the bath to achieve both a conducive gas-liquid interfacial surface area and gas residence time for efficient gas-liquid reactions. In addition, side injection permits the tuyeres to be raised out of the bath during inactive periods of processing thus conserving process gas. Side injection may be the sole means of injecting gases into a metal melt or it may be employed in conjunction with another means of providing gases to a melt, such as with a top lance.

A significant expense in a metal refining process, such as steelmaking processes wherein gases are injected into the melt from below the melt surface, is the consumption of refractory in the area proximate the point of the gas injection due to the high heat of the oxidation reactions and erosiveness of the turbulent liquid metal reaction proximate the point of injection. In the case of a side injection metal refining process, the refractory consumption problem is manifested most prominently at the side of the metal refining vessel in the area proximate the injection point.

Those skilled in the art have addressed this problem by increasing the thickness of the refractory lining in the area proximate the gas injection point. Thus, for a bottom-injected vessel the refractory is considerably thicker at the bottom of the vessel than it is at its sides. This solution to the problem of local high refractory wear rate has been successfully implemented with side-injected vessels.

It is desirable that the lining of a metal refining vessel wear in such a way that no one portion of the lining wears out significantly before the other portions. It has been observed that refractory linings of side-injected steelmaking vessels unexpectedly tend to wear out in the area above the side injection point while the other portions of the lining still have considerable thickness remaining. This is undesirable and costly since the unconsumed lining must be discarded and the vessel relined because of the early failure of the lining in the area above the injection point. This failure mode is not expected since one would expect the higher wear rate to be in the side area proximate the gas injection point and not in the side area above the gas injection point.

At first glance it might appear that the solution to this problem is not difficult. By applying the known expedient, i.e., increasing the lining thickness in the area of high wear rate, one could sucessfully address this problem. However, such a solution has two disadvantages. First it greatly increases the amount of refractory lining used and thus further increases the cost of metal refining. Second, it reduces the volume within the vessel available for the molten metal, thus requiring the refining of a smaller amount of metal per heat, slower injection of gases into the melt or the refining of the metal with an increased risk of overflow or slopping because of the necessarily higher level of the bath surface within the vessel during gas injection.

Therefore it is desirable to have a side-injected metal refining vessel wherein the refractory lining in the side area above the injection point does not wear out significantly earlier than other lining areas, such as in the side area proximate the injection point, without the need for a thicker lining above the injection point than proximate the injection point.

Accordingly, it is an object of this invention to provide an improved side-injected metal refining vessel.

It is a further object of this invention to provide an improved side-injected metal refining vessel wherein greater economy of refractory lining usage can be attained over that possible with heretofore available conventional side-injected metal refining vessels.

SUMMARY OF THE INVENTION

The above and other objects which will become apparent to one skilled in the art upon a reading of this disclosure are attained by the present invention which is:

A metal refining vessel comprising a bottomwall, a sloped section having a lining of consumable refractory and contacting the bottomwall, and a tuyere passing through the lined sloped section proximate the bottomwall enabling side injection of gas into a metal melt during refining, the consumable refractory lining cold face having an axis angle less than that of the consumable refractory lining hot face for a distance, in a direction away from the bottomwall, from the tuyere to a point, such that the lining thickness at the tuyere is at least ten percent greater than the lining thickness at said point, whereby the thickness of the consumable refractory lining substantially constantly decreases throughout the distance from the tuyere to said point.

As used herein, the term "vessel axis" means an imaginary line running through the approximate geometric center of a metal refining vessel in the longitudinal direction.

As used herein, the term "side injection" means the injection of refining gas or gases into a metal refining vessel at an angle perpendicular, or within 45 degrees of perpendicular, to the vessel axis.

As used herein, the term "axis angle" means the degree of angle from the vessel axis.

As used herein, the term "consumable refractory lining" means the portion of the refractory lining which is consumed by the bath during refining and is from time to time replaced altogether. The consumable refractory lining thus may be the entire refractory lining, but generally is only an innermost portion thereof.

As used herein, the term "hot face" means the consumable refractory lining surface intended to contact or face the molten metal during refining.

As used herein, the term "cold face" means the consumable refractory lining surface closest the vessel shell.

As used herein, the term "tuyere" means a device through which gas is conveyed to and injected into a molten metal bath. A tuyere may have the form of a pipe or channel, a porous element, or any other aperture useful for this purpose.

As used herein, the term "lining thickness" means the distance between the hot and cold face surfaces perpendicular to the vessel axis.

BRIEF DESCRIPTION OF THE DRAWINGS

FIG. 1 is a simplified cross-sectional representation of a preferred embodiment of the side-injected metal refining vessel of this invention.

FIG. 2 is a more detailed schematic representation of a preferred embodiment of the refractory lining cross section above the gas injection point of the side-injected metal refining vessel of this invention.

DETAILED DESCRIPTION

The metal refining vessel of this invention will be described in detail with reference to the drawings.

Referring now to FIG. 1, metal refining vessel 1 is comprised of a shell 2 which is generally relatively thin and usually made of metal such as steel. One skilled in the art will recognize the vessel of FIG. 1 as an AOD, or argon oxygen decarburization, steelmaking vessel. The present invention, however, is not limited to only this kind of steelmaking vessel and also includes metal refining vessels for metals other than steel, such as copper.

Vessel 1 comprises a sidewall 3 which is essentially parallel to the vessel axis 4, a bottomwall 5 essentially perpendicular to the vessel axis 4 and a sloped section 6 between the sidewall 3 and the bottomwall 5 and contacting the sidewall 3 and the bottomwall 5 at its opposite ends.

The bottomwall, sloped section and sidewall each have a consumable refractory lining 8 and the top portion of the vessel is lined with refractory lining 7. The consumable refractory lining is generally magnesite-chromite or dolomite type refractory but any effective refractory material may be employed. The consumable refractory lining may be the same throughout the vessel or it may be of different type, or of different quality, at different points in the vessel.

The refractory-lined sidewall, bottomwall, and sloped section cooperate to form hearth 9 within which volume the molten metal is refined. The molten metal is refined by the injection of gas or gases into the molten metal through tuyere 10 which passes through lined sloped section 6 proximate bottomwall 5. Although not shown in FIG. 1, during actual refining, tuyere 10 would be connected to a source of gas or gases such as oxygen and/or an inert gas and the gas or gases would be injected into the molten metal within hearth 9. As shown in FIG. 1, tuyere 10 is preferably located in the lower portion of sloped section 6 proximate the lined bottomwall. The metal refining vessel of this invention may employ more than one tuyere through the sloped section although, as a general rule, the number of tuyeres employed will not exceed 7. After the metal has been refined it is poured out of vessel 1 through vessel mouth 11 and the vessel is ready to refine another heat of metal.

The consumable refractory cold face 12 of sloped section 6 in the area of tuyere 10 is oriented at an angle with respect to the vessel axis. The cold face axis angle is preferably less than 45 degrees and most preferably is in the range of from 10 to 25 degrees. FIG. 1 illustrates a cold face having an axis angle essentially identical to that of the vessel shell 2 although this is not necessarily always the case as when an intermediate nonconsumable or back-up refractory lining of varying thickness is used between the shell and the consumable refractory.

The consumable refractory hot face 13 opposite cold face 12 is oriented at an angle with respect to the vessel axis. The axis angle of hot face 13 is always greater than the axis angle of cold face 12 or put another way, the axis angle of cold face 12 is less than that of hot face 13. The axis angle of hot face 13 is preferably greater than 30 degrees and most preferably is in the range of from 33 to 45 degrees.

For ease of representation cold face 12 and hot face 13 are shown as being smooth. Those skilled in the art will recognize that the cold and hot faces may be stepped, such as when bricks are employed to line the vessel. In such a case the smooth lines shown in FIG. 1 would be approximations.

The defined orientations of the cold and hot faces hold for a distance, in a direction away from the bottomwall, from the tuyere to a point such that the lining thickness at the tuyere is at least 10 percent, preferably at least 20 percent, most preferably at least 40 percent greater than the lining thickness at said point. Thus the thickness of the consumable refractory lining substantially constantly decreases throughout the distance from the tuyere to said point.

In FIG. 1, the lining thickness is shown as changing from the bottomwall to the sidewall. However, it is necessary that the lining thickness decrease only from the tuyere to the defined point. That point could be short of, at, or past the point where the sloped section meets the side wall. Preferably the vertical distance from the tuyere to the defined point is in the range of from 6 to 30 inches and most preferably is in the range of from 15 to 25 inches. By vertical distance it is meant a distance along a line which is essentially parallel to the vessel axis.

FIG. 2 is a more detailed representation of the cold face and hot face orientations of the metal refining vessel of this invention. The numerals of FIG. 2 correspond to those of FIG. 1 for the common elements.

Referring now to FIG. 2, refractory 8 has cold face 12 and hot face 13 and extends from a point where it has a thickness X, to tuyere 10 where is has a thickness XX which exceeds X by at least 10 percent, preferably by at least 20 percent, most preferably by at least 40 percent. Lines M and N are imaginary lines which are parallel to the vessel axis. Hot face 13 is oriented at an axis angle "a" which preferably exceeds 30 degrees and most preferably is within the range of from 33 to 45 degrees. Cold face 12 is oriented at an axis angle "b" which is always less than axis angle "a", preferably is less than 45 degrees and most preferably is within the range of from 10 to 25 degrees. It is preferred that the defined cold face and hot face orientation extend laterally at least five inches, and most preferably at least ten inches, to either side of tuyere 10.

As is readily recognizable, FIG. 1 illustrates an embodiment of this invention where only a portion of the sloped section is covered by refractory lining having the defined hot face and cold face orientation. The defined refractory lining is necessary only in the area of a tuyere and, if there is only one tuyere, the defined refractory lining orientation is necessary only in that one area and not in other areas of the sloped section. When the vessel shell and nonconsumable lining are symmetrical this results in an asymmetric hearth as illustrated in FIG. 1. This asymmetric hearth design is preferred for vessels in which areas of the sloped section are relatively far removed laterally from the area proximate a tuyere and is particularly preferred for small refining vessels since the distances from the tuyere(s) to the opposing refractory wall as well as the height of the bath above the tuyeres can be maximized. In such a vessel having an asymmetric design, the refractory lining covering a sloped section through which there is no tuyere has a cold face 14 and hot face 15 which are conventionally parallel to one another, and has a relatively constant thickness through the distance from the sidewall to the bottomwall.

Alternatively the sloped section of the metal refining vessel may be covered by refractory lining having the defined hot face and cold face orientation throughout the entire circumference of the vessel. When the vessel shell and nonconsumable lining are symmetrical this will result in a vessel having a symmetric hearth.

The metal refining vessel of this invention is further illustrated by the following example which is offered for illustrative purposes and is not intended to be limiting.

A steel making vessel similar to that illustrated in FIG. 1, having a refining capacity of 5 tons underwent a series of refining heats. The average heat comprised 5 tons of steel and lasted for 1.0 hours. The refining process employed was the argon-oxygen decarburization process, or AOD, process. The vessel was equipped with two tuyeres and the refractory lining on the sloped section in the tuyere area had a hot face axis angle of 33 degrees and a cold face axis angle of 20 degrees. This refractory lining had a thickness identical to the thickness of the lining covering the sidewall at the junction of the sloped section and the sidewall, and the lining thickness increased from this point through the distance to the tuyere and at the tuyere exceeded the thickness at the sloped section-sidewall junction by 100 percent. The refractory lining employed was comprised of chromite-magnesite and withstood 70 heats prior to failing.

For comparative purposes the same vessel was used to refine steel but using a conventional lining. The refractory material and average size and time of refining heats were the same as in the example as was the refining process employed. The refractory lining on the sloped section in the tuyere area was thicker than that of the lining on the bulk of the sidewall by 33 percent. However the hot face axis angle and cold face axis angle of this refractory section were the same, both being 20 degrees. This conventionally designed lining withstood only 48 heats prior to failure.

In the particular example described, the steelmaking vessel of this invention provided a 43 percent increase in the amount of steel produced per unit of refractory over that produced using the conventional design.

It is thus demonstrated that the metal refining vessel of this invention provides a significant improvement over the performance of conventional metal refining vessels. This is even more remarkable when one considers that in the example and comparative experiment described, the conventional lining was thicker than that of the vessel of this invention in the upper region of the sloped section, the region where the consumable refractory lining normally fails first. According to heretofore conventional practice one would expect increased lining life to be directly related to increased thickness in the upper region of the sloped section. As shown in the example and comparative experiment, applicant's invention achieves increased lining life while actually decreasing the lining thickness in the important area above the tuyere, thus indicating the unobviousness of applicant's invention.

Although not wishing to be held to any theory, applicant offers the following explanation for the advantageous results achieved by the invention. Heretofore it has been generally accepted that side-injected gas from a tuyere penetrated the melt for some distance toward the vessel axis and then bubbled up through the melt essentially vertically. Applicant surmizes that this conventional thinking is in error in two particulars. First, the side-injected gas penetration toward the vessel axis is much less than conventionally thought. Second, the gas rises through the melt not vertically but at an angle back toward that side through which it was injected due to the laterally sweeping effect of the liquid metal. Applicant's metal refining vessel having the defined refractory lining orientation addresses both of these particulars. First, because the gas penetration is in reality much less than conventionally thought, the oxidation reaction in the area of the injection point is more severe local to that point than conventionally expected. Applicant's invention comprises an extra thick lining at this injection point to cope with the more severe reaction thermal or erosive effects. Second, because the gas rises through the melt closer to the vessel sidewall than conventionally thought, the severity of the oxidation reaction and turbulence on the lining above the tuyere is more severe than conventionally expected. Applicant believes this explains the heretofore puzzling lining failure in this area experienced by conventional side-injected vessels. Applicant's invention comprises, not increased thickness, but a sharp angling away of the lining above the tuyere. In this way the lining better withstands the increased severity by being spaced a greater distance from the rising gas than is a conventional lining above the tuyere. Applicant's invention accomplishes its advantageous results without having to increase lining thickness in this area which would add cost to the refining and reduce the capacity of the vessel.

I claim:

1. A metal refining vessel comprising a bottomwall, a sloped section having a lining of consumable refractory and contacting the bottomwall, and a tuyere passing through the lined sloped section proximate the bottomwall enabling side injection of gas into a metal melt during refining, the consumable refractory lining cold face having an axis angle less than that of the consumable refractory lining hot face for a distance, in a direction away from the bottomwall, from the tuyere to a point, such that the lining thickness at the tuyere is at least ten percent greater than the lining thickness at said point, whereby the thickness of the consumable refractory lining substantially constantly decreases throughout the distance from the tuyere to said point.

2. The vessel of claim 1 wherein the hot face axis angle exceeds 30 degrees.

3. The vessel of claim 1 wherein the hot face axis angle is within the range of from 33 to 45 degrees.

4. The vessel of claim 1 wherein the cold face axis angle is less than 45 degrees.

5. The vessel of claim 1 wherein the cold face axis angle is within the range of from 10 to 25 degrees.

6. The vessel of claim 1 wherein the lining thickness at the tuyere is at least 20 percent greater than the lining thickness at said point.

7. The vessel of claim 1 wherein the lining thickness at the tuyere is at least 40 percent greater than the lining thickness at said point.

8. The vessel of claim 1 wherein the sloped section has a lining having the defined hot face and cold face orientation throughout the entire circumference of the vessel's sloped section resulting in a substantially symmetric hearth.

9. The vessel of claim 1 wherein the sloped section has a lining having the defined hot face and cold face orientation throughout less than the entire circumference of the vessel's sloped section resulting in an asymmetric hearth.

10. The vessel of claim 1 wherein the refractory material comprises magnesite chromite or dolomitic type refractory.

11. The vessel of claim 1 wherein the defined lining of constantly increasing thickness extends laterally up to 5 inches to either side of the tuyere.

12. The vessel of claim 1 having more than one tuyere.

13. The vessel of claim 1 having a sidewall, essentially parallel to the vessel axis, in contact with the sloped section at the opposite end from that which contacts the bottomwall.

14. The vessel of claim 13 wherein said point is at the conjunction of the sloped section and the sidewall.

15. The vessel of claim 13 wherein said point is short of the conjunction of the sloped section and the sidewall.

16. The vessel of claim 1 wherein said vessel is a steelmaking vessel.

17. The vessel of claim 1 wherein the vertical distance from the tuyere to said point is in the range of from 6 to 30 inches.

18. A process for refining metal comprising injecting refining gas into a metal melt through a tuyere beneath the melt surface said metal melt contained in a refining vessel comprising a bottomwall and a sloped section having a lining of consumable refractory and contacting the bottomwall, said tuyere passing through the lined sloped section proximate the bottomwall enabling side injection of gas into the metal melt during refining, the consumable refractory lining cold face having an axis angle less than that of the consumable refractory lining hot face for a distance, in a direction away from the bottomwall, from the tuyere to a point, such that the lining thickness at the tuyere is at least ten percent greater than the lining thickness at said point.

* * * * *